US006256826B1

(12) United States Patent
Darne

(10) Patent No.: US 6,256,826 B1
(45) Date of Patent: Jul. 10, 2001

(54) SELF-ROTATING TOOTHBRUSH

(75) Inventor: François Darne, Paris (FR)

(73) Assignee: Supreme Teeth Co., Ltd., Mauritius (FR)

( * ) Notice: Subject to any disclaimer, the term of this patent is extended or adjusted under 35 U.S.C. 154(b) by 0 days.

(21) Appl. No.: 09/355,377

(22) PCT Filed: Mar. 8, 1999

(86) PCT No.: PCT/FR99/00512

§ 371 Date: Jul. 26, 1999

§ 102(e) Date: Jul. 26, 1999

(87) PCT Pub. No.: WO99/47021

PCT Pub. Date: Sep. 23, 1999

(30) Foreign Application Priority Data

Mar. 18, 1998 (FR) ..... 98 03288

(51) Int. Cl.[7] ..... A46B 9/04

(52) U.S. Cl. ..... 15/28; 15/167.1; 15/180

(58) Field of Search ..... 15/22.1, 28, 29, 15/167.1, 180, 27

(56) References Cited

U.S. PATENT DOCUMENTS 4,504,998 * 3/1985 Price et al. ..... 15/186

FOREIGN PATENT DOCUMENTS

268497 * 8/1950 (CH) ..... 15/27
4239 * 10/1956 (DE) ..... 15/22.1
8909949 * 12/1989 (DE) .
765642 * 4/1997 (EP) .
2590779 * 3/1988 (FR) .
2622089 * 4/1989 (FR) ..... 15/28
90/09121 * 8/1990 (WO) .

* cited by examiner

*Primary Examiner*—Mark Spisich
(74) *Attorney, Agent, or Firm*—Rines and Rines

(57) ABSTRACT

The motorless rotary toothbrush is made of an elongated grip (10) which bears at one end a freely rotating disk (12) on an axis substantially perpendicular to the longitudinal axis (16) of the distal end of the grip. The disk (12) bears the bristles (20) of the brush. The bristles (20) are implanted symmetrically vis-à-vis the rotary axis (14) of the disk (12). The stem of each bristle of at least one outer ring (18) of the disk (12) forms a certain angle (a) with the radial plane going through the stem of the bristle (20).

8 Claims, 1 Drawing Sheet

SELF-ROTATING TOOTHBRUSH

FIELD OF THE INVENTION

The present invention relates to toothbrushes, and more precisely, to a rotary toothbrush. Further objects of the invention will be evident from the following description.

DESCRIPTION OF PRIOR ART

Rotary toothbrushes having an elongated grip, with a rotary disk bearing the bristles of the brush at one end are wellknown. The grip usually contains a motor controlling the rotation of the disk. When the toothbrush is commercialized for a domestic use, it generally includes an electrical micromotor, whereas when the toothbrush is to be used by dentists, it includes a fluidic or compressed air motor.

An electrical rotary toothbrush for a domestic use is described in EP-A-0,765,642.

These toothbrushes are efficient enough, but the user encounters problems when travelling, because of the presence of the motor. Besides, they are expensive as they require a micro-mechanical technology due to the motor itself, of the shaft connecting the motor with the rotary brush disk, and the gearing system between the driving shaft and the disk, if the rotary axis is the not the same as the motor's.

In order to obviate these inconveniences, the document FRA-2 590 779 discloses a "self-rotating toothbrush" in which the difference between the friction forces of the teeth against the bristles in the center of the disk and near its border generates a rotation of the disk. However, such a toothbrush forces the user to press a part of the periphery of the disk on their teeth more firmly than on the central part, which causes a non regular wear of the bristles and an insufficient cleaning of the area of the teeth covered by the outer part of the disk, as this zone does not fully profit from the rotary effect.

SUMMARY OF THE INVENTION

The invention concerns a motorless rotary toothbrush, made of an elongated grip which bears at one distal end, a freely rotating disk on an axis substantially perpendicular to the longitudinal axis of the distal end of the grip, the disk bearing the bristles of the brush.

As per the invention, the bristles are implanted symmetrically vis-à-vis the axis of rotation of the disk with, the stem of each of the bristles of at least one ring of the disk shown as the outermost ring forming a given acute angle with the radial plane going through the stem of the bristle.

If necessary, this given angle can be made to diminish with the distance between the stem of the bristle and the rotary axis of the disk.

According to one embodiment, the bristles of at least one outer ring show a slight upward curve, causing the tangent to the tip of each bristle to form an angle with the radial plane passing through the stem of the bristle, slightly larger than to the aforementioned given angle.

This is a very worthwhile way to enable the projection of each bristle of at least one outer ring on the plate to form an angle less than about 7 with the tangent of the disk passing through the radius from which the bristle is stemming, and even more conveniently, the projection is roughly parallel to this tangent.

BRIEF DESCRIPTION OF THE DRAWINGS

The invention will be better understood, and other objects, advantages and characteristics thereof will appear more clearly, when reading the following description of the best embodiments thereof given by way of non-limitative examples and with reference to the accompanying drawings in which.

DESCRIPTION OF THE PREFERRED EMBODIMENTS

Figure 1:
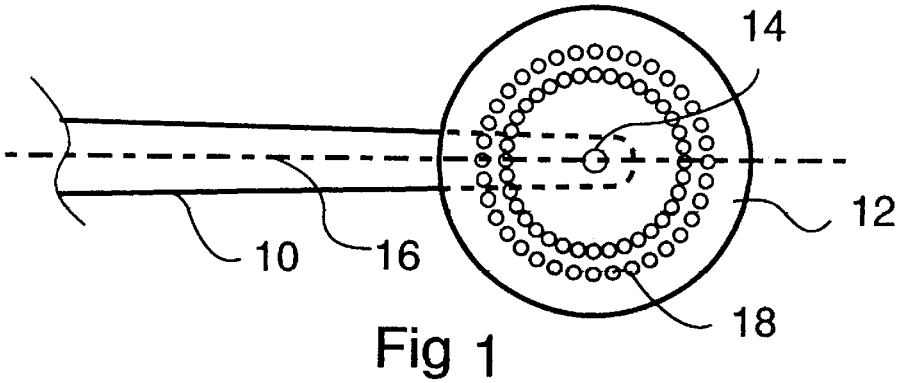
FIG. 1 is an external view from above of an embodiment of the toothbrush of one of the preferential designs, from which the bristles have been taken away for more clarity.

Now referring to the accompanying drawings, FIG. 1 shows a toothbrush as disclosed by the document FR-A-2 590 779. A longitudinally extending grip 10 bears at its end a tranverse disk 12 set with a free rotation around an axis 14 roughly perpendicular to the longitudinal axis 16 of the distal end of the grip 10. An outer ring 18 and an inner concentric ring of bristle implants have been represented, but it is understood that these implants are spread at regular intervals on the whole surface of the disk 12, in a symmetrical way with respect to the axis of rotation 14 of the disk.

In the example represented, the axis of rotation 14 is materialized by a shaft (as best seen on FIG. 2), but it is understood that the other solutions disclosed by the document FR-A-2 590 779, among others, can be selected.

Figure 2:
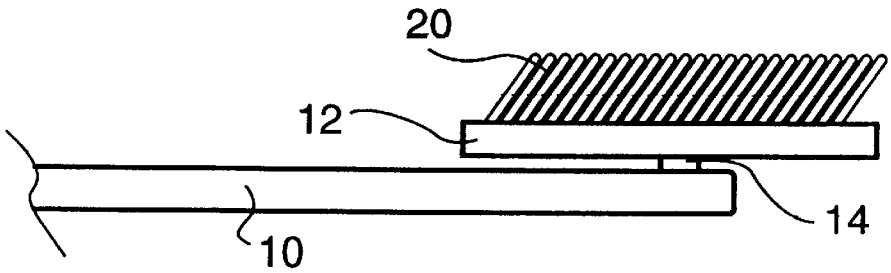
FIG. 2 represents a lateral view of a toothbrush meeting the invention schematics.

On FIG. 2, which is a schematic lateral view of a toothbrush according to one embodiment of the invention, one will be able to notice that the bristles 20 are inclined with respect to the axis of rotation 14. As a matter of fact, as it will be described hereinafter, the bristles 20 are implanted symmetrically vis-à-vis the axis of rotation 14 of the disk 12, the lower stem of each bristle of the outer ring of the disk forming a given acute angle with the radial plane passing through the stem of the bristle.

This produces an important difference in friction forces on each side of the disk 12 when the user does a translation movement with the grip 10, the upper tips of the bristles 20 being in contact with the teeth. This difference in the forces produces a rotary movement of the grip 10 in one direction when the translation movement of the grip 10 is effected in one direction, and a rotary movement in the opposite direction when the translation movement of the grip is reversed. So doing, the self-rotating effect of the brush is achieved when used, without the use of any motor.

Figure 3:
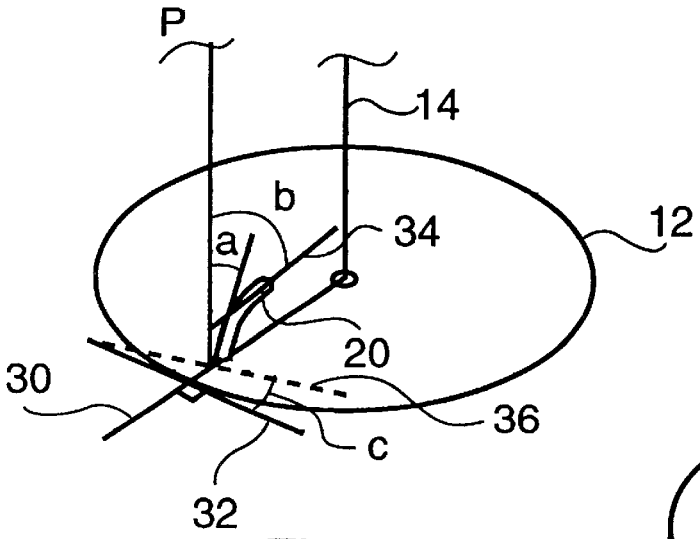
FIG. 3 illustrates geometrically the implants of the bristles of the brush head of the present invention.

FIG. 3 illustrates the invention more geometrically with a sketch of a bristle 20 implanted on a disk 12 in perspective. The lower stem of the bristle 20 is implanted on a radius 30 of the disk 12, this radius being of course, perpendicular to the corresponding tangent 32. A radial plane P is created by the rotary axis 14 of the disk 12 and the corresponding radius 30 at the point where the bristle 20 is implanted.

The stem of the bristle 20 thus forms an angle a with the radial plane P. The upward portion of the bristle shows a slight curve, with the tangent 34 at the tip of the bristle, forming an acute angle b with the radial plane P going through the stem of the bristle. This angle b is slightly larger than the aforementioned angle a.

This given angle a advantageously ranges between 1 and about 6°; and the possible angle b, shown enlarged in FIG. 3 for the clarity of the sketch, ranges between about 3 and about 9°, according to the angle a opening.

To optimize the efficiency of the toothbrush, this angle a should ideally decrease with the distance between the stem of the bristle 20 and the rotary axis 14.

The projection of the bristle 20 on the plane of the disk 12 is a sensibly straight line 36. This straight line 36 intersects the tangent 32 forming here an angle c. This angle c may preferably be less than about 7°, and even null, with the line 36 parallel to the tangent 32.

Figure 4:
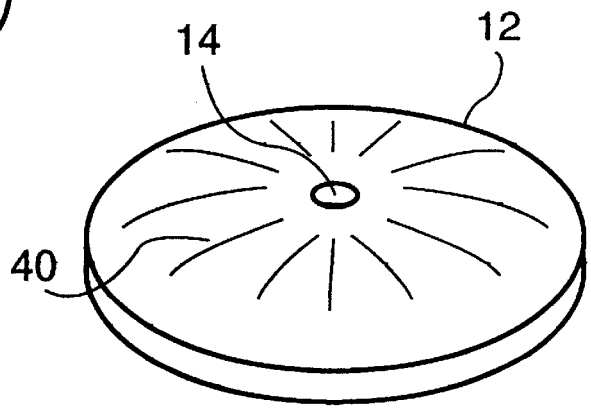
FIG. 4 illustrates an alternative design of the brush head bearing the bristles.

As per FIG. 4, the disk 12 can also, if wanted, form a slightly convex shape in its center, the bristles having, if necessary, various lengths according to the distance between each of their stem and the rotary axis 14.

A motorless rotary toothbrush has been so defined, requiring neither motor nor power source, nor a costly micromechanical device. Such a toothbrush can be easily carried by a travelling user who can use a high efficiency toothbrush having very little cost.

Although the invention has been shown and described in what are now considered as the preferred embodiments of the present invention, it is expected of the skilled man to be able to bring some changes and alterations without departing from the scope of the invention as claimed hereinafter.

Particularly, the nature of the bristle itself 20 is of little importance compared to the invention, being understood that a certain rigidity of each bristle, especially on the outer ring, is essential to meet the optimal good use of the toothbrush according to this invention. This rigidity shall not be developed further here, since it falls within the normal professionals' competence.

What I claim is:

1. A motorless rotary toothbrush having a longitudinally axially extending elongated grip one distal end of which transversely carries a rotatable disk freely rotating around a rotary axis extending substantially perpendicular to the longitudinal axis of said grip distal end, said disk, bearing bristles of the toothbrush, with a plurality of bristles each provided with a lower implantable stem and an upwardly curving tip, wherein said bristles are implanted in the disk in rings symmetrically vis-à-vis said rotary axis of said disk, with the stem of each bristle of at least one ring of said disk forming an acute angle (a) with the radial plane formed by said rotary axis of the disk and the radius of the disk that intersects the point where the bristle stem is implanted.

2. The toothbrush according to claim 1, wherein said angle (a) decreases with the distance between said stem of the bristle and said rotary axis.

3. The toothbrush according to claim 1, wherein the tangent at the upwardly curving tip of each bristle of at least one ring forms an acute angle (b) with the radial plane going through the stem of the bristle, slightly larger than said angle (a).

4. The toothbrush according to claim 1, wherein a projection of each bristle of at least one ring on the plane of said ring forms an angle (c) of less than 7° with a tangent to the disk passing through the radius on which said bristle is implanted.

5. The toothbrush according to claim 1, wherein a projection of each bristle of at least one ring on the plane of said ring is roughly parallel to a tangent to the disk passing through the radius on which said bristle is implanted.

6. The toothbrush according to claim 1, wherein said angle (a) is between about 1° and about 6°.

7. The toothbrush according to claim 1, wherein said disk take a slighted convex shape in its center.

8. The toothbrush according to claim 1, wherein the tangent to said upwardly curving bristle tip forms an acute angle (b) with said radial plane that is slightly larger than said angle (a), such that different friction forces are created when a user performs grip translation movement with the bristle tips contacting the teeth of the user, generating rotary movements in opposite directions for opposite translation movements.

* * * * *